US012378020B2

(12) United States Patent
Nagashima et al.

(10) Patent No.: US 12,378,020 B2
(45) Date of Patent: Aug. 5, 2025

(54) BAGMAKING AND PACKAGING APPARATUS

(71) Applicant: ISHIDA CO., LTD., Kyoto (JP)

(72) Inventors: Ryota Nagashima, Ritto (JP); Satoshi Hashimoto, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 0 days.

(21) Appl. No.: 18/523,925

(22) Filed: Nov. 30, 2023

(65) Prior Publication Data

US 2024/0190598 A1 Jun. 13, 2024

(30) Foreign Application Priority Data

Dec. 8, 2022 (JP) ..... 2022-196189
Jan. 11, 2023 (JP) ..... 2023-002167

(51) Int. Cl.
*B65B 9/207* (2012.01)
*B65B 41/12* (2006.01)

(52) U.S. Cl.
CPC ..... *B65B 9/207* (2013.01); *B65B 41/12* (2013.01)

(58) Field of Classification Search
CPC ..... B65B 41/12; B65B 51/306; B65B 57/005; B65B 59/04; B65B 65/003; B65B 9/20; B65B 9/207
See application file for complete search history.

(56) References Cited

U.S. PATENT DOCUMENTS 7,124,559 B2 * 10/2006 Taylor ..... B65B 59/04 53/551
2002/0073660 A1 * 6/2002 Fukuda ..... B29C 66/7373 53/551
2004/0088948 A1 * 5/2004 Yamamoto ..... B65B 9/2021 53/134.1

(Continued)

FOREIGN PATENT DOCUMENTS

AU 2016216967 A1 8/2017
JP 2002337817 A * 11/2002

OTHER PUBLICATIONS

Machine translation of JP-2002337817-A (Year: 2002).*
European Search Report dated May 6, 2024, issued in connection with corresponding European application 23214131.7-1014.

*Primary Examiner* — Anna K Kinsaul
*Assistant Examiner* — Himchan Song
(74) *Attorney, Agent, or Firm* — United IP Counselors, LLC

(57) ABSTRACT

A bagmaking and packaging apparatus forms a sheet-form film into a tubular shape around a tube, which tubular film is transversely sealed after product is introduced therein. The bagmaking and packaging apparatus includes multiple upright support posts that form a frame. The support posts include a first support post group disposed on one side in the left and right direction and a second support post group disposed on the other side. A first support post disposed foremost in the first support post group extends from a low position to a position higher than the transverse sealing mechanism and is disposed forward of a center O of the tube. A second support post disposed foremost in the second support post group extends from a low position to a position higher than the transverse sealing mechanism and is disposed rearward of the center of the tube.

6 Claims, 8 Drawing Sheets

(56) References Cited

U.S. PATENT DOCUMENTS

| | | | | |
|---|---|---|---|---|
| 2005/0016125 | A1* | 1/2005 | Kinigakis | B65B 9/2028 53/551 |
| 2010/0037568 | A1* | 2/2010 | Hashimoto | B65B 9/22 53/551 |
| 2012/0285129 | A1* | 11/2012 | Kamigaito | B29C 66/8167 53/548 |
| 2019/0210298 | A1* | 7/2019 | Kageyama | B65B 1/32 |

* cited by examiner

BAGMAKING AND PACKAGING APPARATUS

CROSS-REFERENCE TO RELATED APPLICATIONS

This application claims the priority benefit of Japanese patent application No. 2022-196189 filed Dec. 8, 2022, and Japanese patent application No. 2023-002167 filed Jan. 11, 2023, the contents of both of which Japanese applications are incorporated herein by reference.

TECHNICAL FIELD

The claimed invention relates to bagmaking and packaging apparatuses.

BACKGROUND

Bagmaking and packaging apparatus such as disclosed in JP-A No. 2002-337817 are known which perform bagmaking and packaging by feeding product from above to the inside of a tubular film, in which a film has been formed in a tubular shape, and transversely sealing tops and bottoms of the tubular film. In such bagmaking and packaging apparatus, maintenance work such as replacing, in accordance with the sizes of the bags for example, a former mechanism that forms the film in the tubular shape and cleaning the area around the former mechanism occurs.

In the bagmaking and packaging apparatus disclosed in JP-A No. 2002-337817, as four support posts extending as far as the vicinity of the upper end of the former mechanism are disposed around the former mechanism, there is a possibility that the support posts hinder the maintenance work. As a measure to counter reduced maintainability in the bagmaking and packaging apparatus disclosed in JP-A No. 2002-337817, it is possible, for example, to increase the distance between the four support posts to ensure work space. However, such a measure causes another problem, which is that the apparatus size increases.

SUMMARY OF THE CLAIMED INVENTION

A bagmaking and packaging apparatus pertaining to a first aspect of the claimed invention performs bagmaking and packaging. The bagmaking and packaging apparatus comprises a film supply unit, a former mechanism, a transverse sealing mechanism, and multiple support posts. The film supply unit is disposed in a rear portion of the bagmaking and packaging apparatus. The film supply unit is configured to supply sheet-like film. The former mechanism includes a former and a tube. The former mechanism is disposed forward of a film supply unit. The former mechanism is configured to form the sheet-like film supplied from the film supply unit in a tubular shape. The transverse sealing mechanism is configured to transversely seal the tubular film in which a product is supplied from above. The support posts form a frame that surrounds at least part of each of the film supply unit, the former mechanism, and the transverse sealing mechanism. The support posts include a first support post group and a second support post group. Each of the first support post group and the second support post group includes a plurality of the support posts. The support posts of the first support post group are disposed on one lateral side of the bagmaking and packaging apparatus in a left and right direction, and the support posts of the second support post group are disposed on the other lateral side of the bagmaking and packaging apparatus in the left and right direction. A first support post disposed foremost among the support posts of the first support post group extends from a low position to a position higher than the transverse sealing mechanism and, when viewed from above, is disposed forward of a center of the tube. A second support post disposed foremost among the support posts of the second support post group extends from a low position to a position higher than the transverse sealing mechanism and, when viewed from above, is disposed rearward of the center of the tube.

In the bagmaking and packaging apparatus of the first aspect, because the second support post is disposed in the above-described position, maintenance space can be ensured on the side of the bagmaking and packaging apparatus in the left and right direction where the second support post group is disposed while inhibiting an increase in the size of the bagmaking and packaging apparatus.

Furthermore, in the bagmaking and packaging apparatus of the first aspect, on the side of the bagmaking and packaging apparatus in the left and right direction where the first support post group is disposed, the first support post is disposed in the above-described position. Thus, various devices and parts of the bagmaking and packaging apparatus can be solidly supported.

A bagmaking and packaging apparatus pertaining to a second aspect of the claimed invention is the bagmaking and packaging apparatus of the first aspect, wherein the first support post is disposed forward of the tube.

In the bagmaking and packaging apparatus of the second aspect, even when a heavy object is disposed forward of the second support post in the upper portion of the bagmaking and packaging apparatus or when the bagmaking and packaging apparatus is provided with a part that causes the bagmaking and packaging apparatus to vibrate, the heavy object can be solidly supported and vibration of the bagmaking and packaging apparatus can be inhibited.

A bagmaking and packaging apparatus pertaining to a third aspect of the claimed invention is the bagmaking and packaging apparatus of the first aspect or the second aspect, wherein the second support post is disposed rearward of the tube.

In the bagmaking and packaging apparatus of the third aspect, it is easy to ensure sufficient workspace around the former mechanism. For example, when replacing the former mechanism, movement of the former mechanism is less likely to be obstructed by the second support post.

A bagmaking and packaging apparatus pertaining to a fourth aspect of the claimed invention is the bagmaking and packaging apparatus of any of the first aspect to the third aspect, wherein the first support post supports a member disposed above the former mechanism.

Sometimes a heavy object such as a metal detector that detects metal contaminants in the supplied product is disposed above the former mechanism. If such a heavy object is disposed in the upper portion of the bagmaking and packaging apparatus and both the first support post and the second support post are disposed rearward of the center of the tube, there is a risk that the balance in the support will be upset, resulting in a deterioration in the installation stability of the bagmaking and packaging apparatus.

In contrast, because the bagmaking and packaging apparatus of the fourth aspect has the first support post disposed in the above-described position, even if such a heavy object is present, the heavy object can be solidly supported by the frame.

A bagmaking and packaging apparatus pertaining to a fifth aspect of the claimed invention is the bagmaking and packaging apparatus of any of the first aspect to the fourth aspect, further including a cover that covers at least a front side of the former mechanism. The first support post supports the cover.

Sometimes a cover that covers the former mechanism is installed for purposes of safety and hygiene. In the bagmaking and packaging apparatus of the fifth aspect, such a cover can be solidly supported by the first support post disposed in the above-described position.

A bagmaking and packaging apparatus pertaining to a sixth aspect of the claimed invention is the bagmaking and packaging apparatus of any of the first aspect to the fifth aspect, wherein the first support post supports a movable member.

When the bagmaking and packaging apparatus is provided with a movable member (a member driven to move by a drive unit), vibration may occur as a result of the movable member moving.

However, because the bagmaking and packaging apparatus of the sixth aspect has the first support post disposed in the above-described position and the stability of the frame is high, even if a movable member that causes vibration is present, vibration of the bagmaking and packaging apparatus can be reliably inhibited.

With such a configuration and arrangement of a bagmaking and packaging apparatus in accordance with the claimed invention, a balance between stable support of various devices and parts of the bagmaking and packaging apparatus and high maintainability can be achieved while inhibiting an increase in the apparatus size.

DESCRIPTION OF EMBODIMENTS

A bagmaking and packaging apparatus 100 that is an embodiment of the bagmaking and packaging apparatus of the claimed invention will be described with reference to the drawings. It will be noted that the following embodiment is merely a specific example of the claimed invention and is not intended to limit the technical scope of the claimed invention.

In the following description, expressions such as perpendicular, orthogonal, horizontal, and vertical may be sometimes used to describe directions and positional relationships, but these expressions are not limited to their strict senses and include cases where that which they describe are substantially perpendicular, orthogonal, horizontal, or vertical. Furthermore, in the following description, expressions such as front, rear, above, below, left, and right are used to indicate directions and such. Unless otherwise specified, front, rear, above, under, left, and right here follow the directions of the arrows added to the drawings.

It will be noted that in the present disclosure, the side where a later-described film supply unit 300 is disposed as viewed from the position of a later-described bagmaking and packaging unit 200 will be defined as the rear, and the side where the bagmaking and packaging unit 200 is disposed as viewed from the position of the film supply unit 300 will be defined as the front. Furthermore, a direction that is a horizontal direction and orthogonal to the front and rear direction in which the bagmaking and packaging unit 200 and the film supply unit 300 are lined up will be defined as the left and right direction.

(1) Packaging and Inspection System

Figure 1:
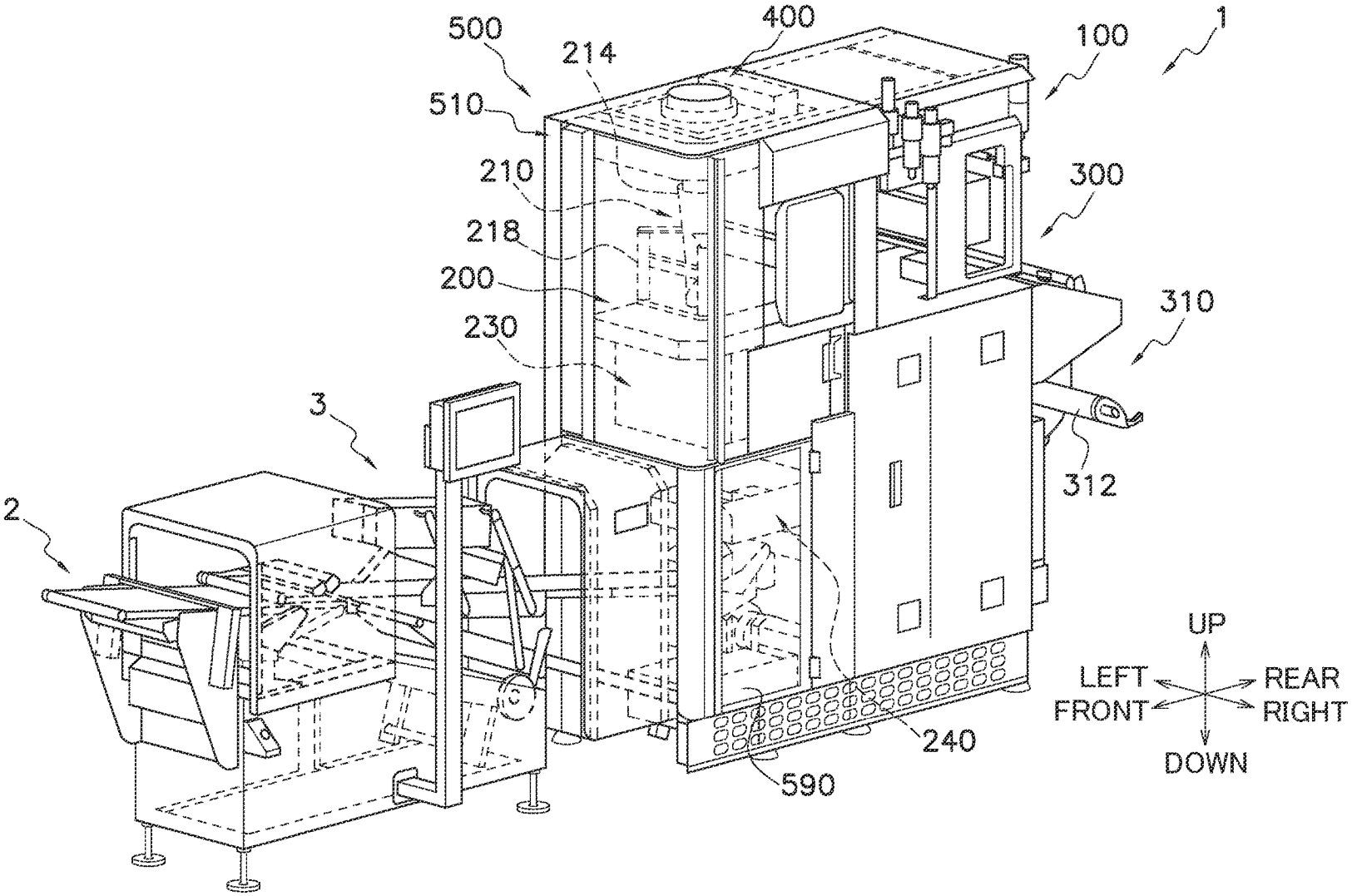
FIG. 1 is a schematic perspective view of a packaging and inspection system including a bagmaking and packaging apparatus of an embodiment of the claimed invention.
Figure 2:
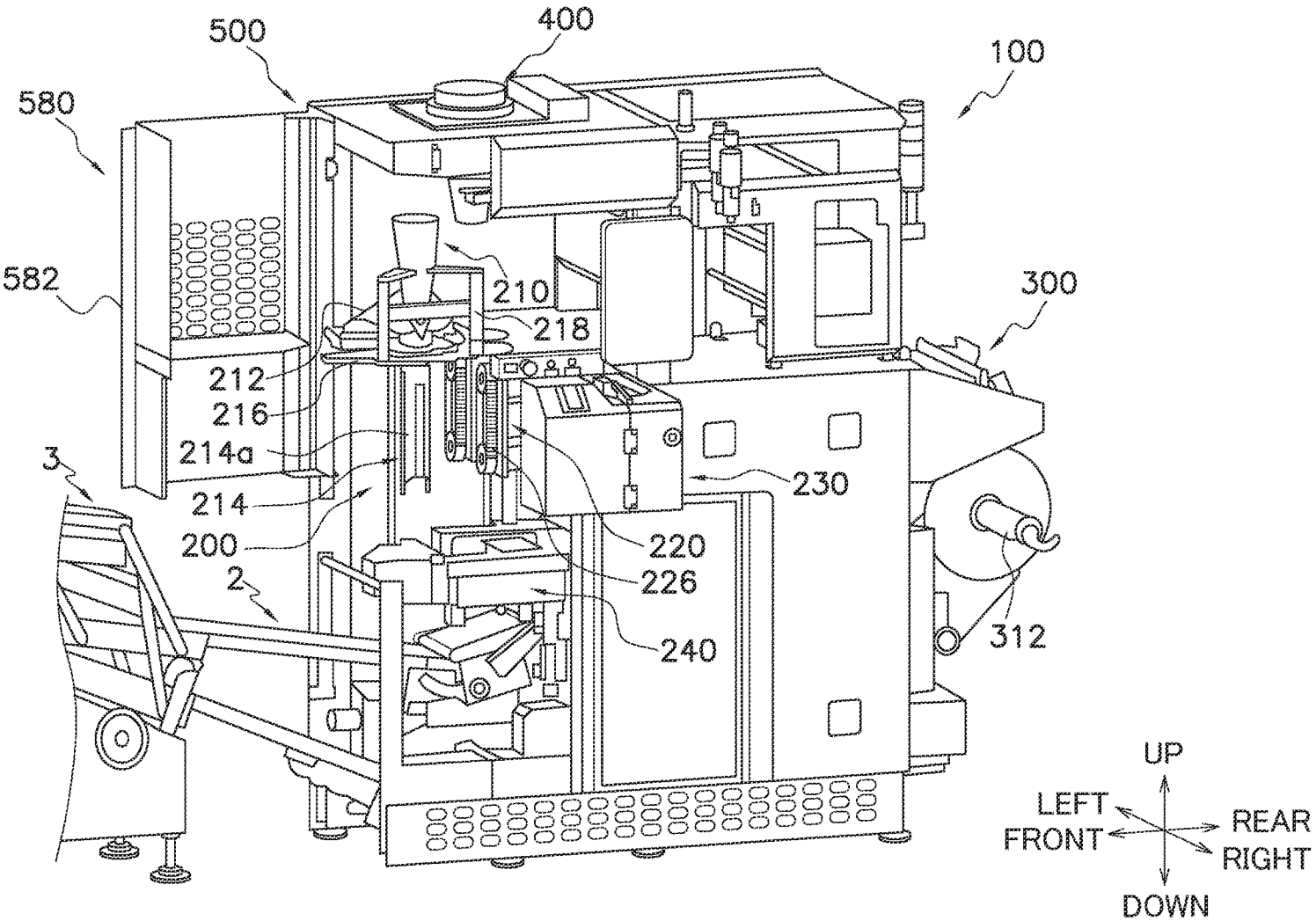
FIG. 2 is a schematic perspective view of the bagmaking and packaging apparatus of FIG. 1.
Figure 3:
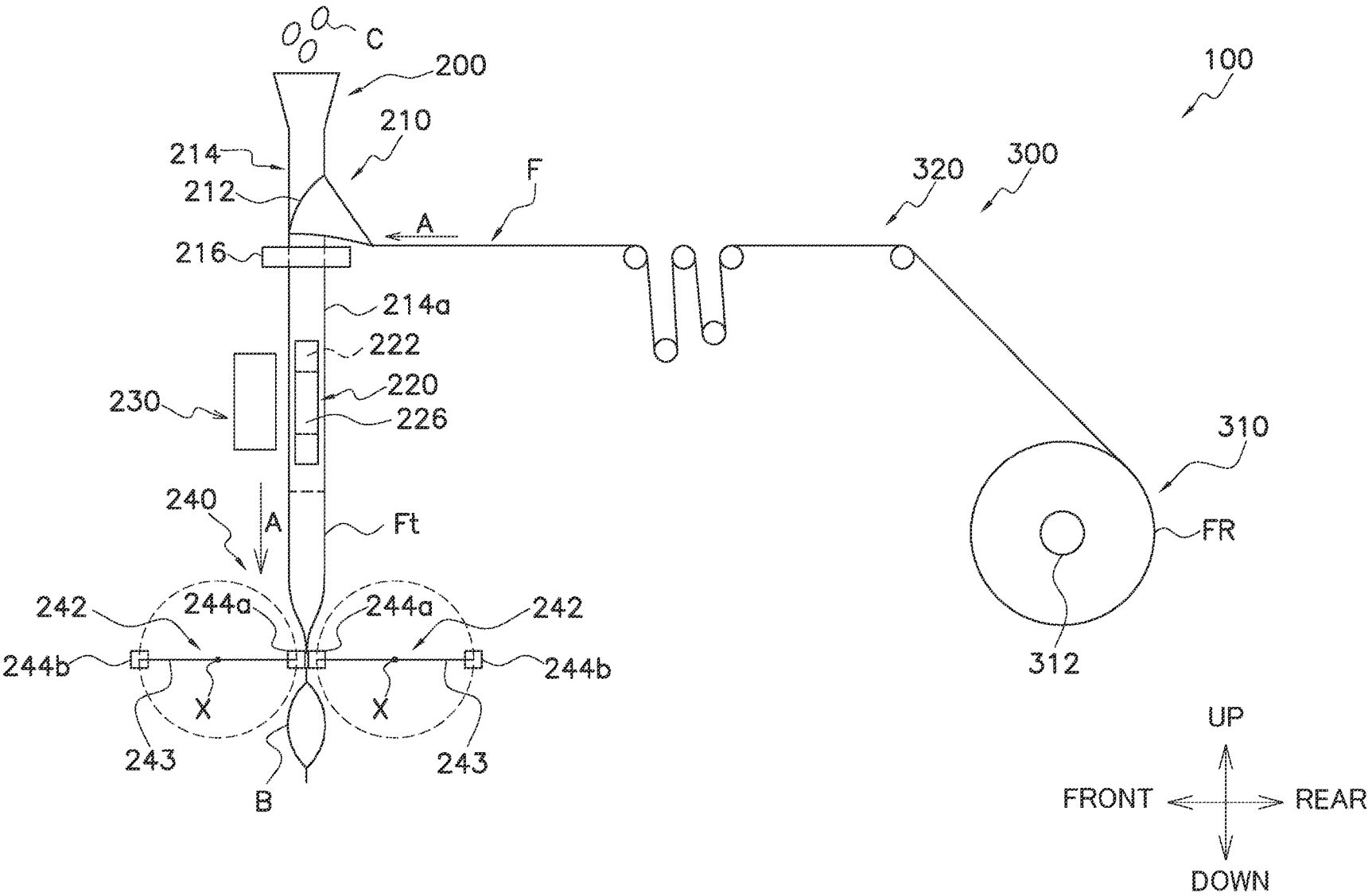
FIG. 3 is a diagram showing the schematic configuration of the bagmaking and packaging apparatus of FIG. 1.

A packaging and inspection system 1 including the bagmaking and packaging apparatus 100 pertaining to the embodiment of the claimed invention will now be described with reference to FIG. 1 to FIG. 3. FIG. 1 is a schematic perspective view of the packaging and inspection system 1 including the bagmaking and packaging apparatus 100. FIG. 2 is a schematic perspective view of the bagmaking and packaging apparatus 100. FIG. 3 is a diagram showing the schematic configuration of the bagmaking and packaging apparatus 100.

It will be noted that FIG. 2 illustrates a state in which a later-described door 582 disposed in the front upper portion of the bagmaking and packaging apparatus 100 is open and a protective plate 590 (see FIG. 1) disposed in the front lower portion of the bagmaking and packaging apparatus 100 is detached. Furthermore, FIG. 2 illustrates a state in which, for the purpose of maintenance or the like, a later-described former mechanism 210 and longitudinal sealing mechanism 230 have been moved from the positions they are in when the bagmaking and packaging apparatus 100 is operating.

As shown in FIG. 1, the packaging and inspection system 1 mainly includes the bagmaking and packaging apparatus 100, a conveyance apparatus 2, and a seal checker 3.

The bagmaking and packaging apparatus 100 makes a bag-like packaging material from a sheet-like film F to thereby make bags B containing a product C inside (see FIG. 3). The product C to be contained in the bags B is supplied to the bagmaking and packaging apparatus 100 from a combination weigher (not shown in the drawings) disposed above the bagmaking and packaging apparatus 100. The bags B made by the bagmaking and packaging apparatus 100 are conveyed by the conveyance apparatus 2. The seal checker 3 checks the seals of the bags B (i.e., whether the bags B are airtight) conveyed by the conveyance apparatus 2.

Here, the combination weigher uses multiple weigh hoppers to measure weights of the product C, combines weigh values obtained by the multiple weigh hoppers so that the total weight thereof is in a predetermined weight range, and drops the product C for which the total combined weight is within the predetermined weight range to thereby supply it to the bagmaking and packaging apparatus 100.

The conveyance apparatus 2 may be a conveyor extending forward from below a transverse sealing mechanism 240 of the bagmaking and packaging apparatus 100. The conveyance apparatus 2 conveys forward the bags B made by the bagmaking and packaging apparatus 100 and transfers them to a process downstream of the packaging and inspection system 1 (e.g., a conveyor that conveys the bags B to a box packing apparatus).

As shown in FIG. 1 to FIG. 3, the bagmaking and packaging apparatus 100 mainly includes a film supply unit 300, a bagmaking and packaging unit 200, a metal inspection device 400, a frame 500, and a control device (such as computer, control board and PLC not shown in the drawings). The film supply unit 300 is disposed in the rear portion of the bagmaking and packaging apparatus 100. The film supply unit 300 supplies the sheet-like film F to the bagmaking and packaging unit 200 disposed forward of the film supply unit 300. The bagmaking and packaging unit 200 is disposed in the front portion of the bagmaking and packaging apparatus 100. The bagmaking and packaging unit 200 forms the sheet-like film F in a tubular shape and transversely seals the film F formed in the tubular shape (a tubular film Ft) to make the bags B. The metal inspection device 400 inspects for contaminants (metal) in the product C dropped and supplied from the combination weigher (not shown in the drawings) to the bagmaking and packaging apparatus 100. The frame 500 mainly supports the film supply unit 300, the bagmaking and packaging unit 200, and the metal inspection device 400. The control device controls the operation of each part of the film supply unit 300 and the bagmaking and packaging unit 200 and performs various calculations and processes.

(2) Bagmaking and Packaging Apparatus

The bagmaking and packaging apparatus 100 will now be described in detail.

(2-1) Film Supply Unit

The film supply unit 300 is disposed in the rear portion of the bagmaking and packaging apparatus 100. The film supply unit 300 is disposed rearward of the bagmaking and packaging unit 200 and next to the bagmaking and packaging unit 200. The film supply unit 300 supplies the sheet-like film F to a later-described former mechanism 210 of the bagmaking and packaging unit 200 disposed forward of the film supply unit 300.

As shown in FIG. 3, the film supply unit 300 mainly includes a film roll support mechanism 310 and a guide mechanism 320.

The film roll support mechanism 310 holds a film roll FR in which the sheet-like film F is wound about a core (not shown in the drawings). The film roll support mechanism 310 uses a drive unit such as a motor (not shown in the drawings) to rotate a shaft 312 to which the core of the film roll FR is attached (see FIG. 1 to FIG. 3) and pay out the film F from the film roll FR.

The guide mechanism 320 includes plural rollers disposed along a conveyance path of the film F. The guide mechanism 320 guides to the former mechanism 210 of the bagmaking and packaging unit 200 the film F paid out from the film roll FR.

(2-2) Bagmaking and Packaging Unit

As shown in FIG. 3, the bagmaking and packaging unit 200 mainly includes a former mechanism 210, a conveyance mechanism 220, a longitudinal sealing mechanism 230, and a transverse sealing mechanism 240.

The former mechanism 210 mainly includes a former 212, a tube 214, a plate 216, and a grip unit 218.

The former 212 is disposed so as to surround the tubular tube 214 and forms in a tubular shape the sheet-like film F conveyed thereto from the film supply unit 300 disposed in the rear portion of the bagmaking and packaging apparatus 100 by bending the film F so that left and right end portions of the film F in the width direction overlap each other. The tubular film Ft formed by the former 212 is guided so as to become wrapped around the outer peripheral surface of the lower portion of the tubular tube 214 and is conveyed downward in a state in which it is wrapped around the tube 214. It will be noted that hereinafter the portion of the tube 214 around which the tubular film Ft is wrapped is sometimes called the portion 214*a*.

The tube 214 is a tubular member that extends in the vertical direction and has upper and lower end portions that are open. The lower end of the tube 214 is disposed higher than the transverse sealing mechanism 240 (higher than areas where later-described rotating bodies 242 of the transverse sealing mechanism 240 rotate) so as not to hinder the movement of the rotating bodies 242. The tube 214 receives the falling product C in the upper opening of the tube 214 and supplies, from the lower opening of the tube 214 to the inside of the tubular film Ft, the product C fed through the upper opening.

The plate 216 is mounted on and secured to a mount (not shown in the drawings) supported by the frame 500, and is supported by the frame 500 via the mount. The former 212 and the tube 214 are attached to the plate 216 directly or via another member, and the plate 216 supports the former 212 and the tube 214. The grip unit 218 is attached to the plate 216 directly or via another member. When attaching the former mechanism 210 to the mount or detaching the former mechanism 210 from the mount, a worker grips hold of the grip unit 218 and moves the former mechanism 210.

The conveyance mechanism 220 is disposed under the plate 216 of the former mechanism 210. The conveyance mechanism 220 is disposed on the left and right sides of the portion 214*a* of the tube 214 around which the tubular film Ft is wrapped. The conveyance mechanism 220 conveys to the former mechanism 210 the film F paid out from the film roll FR and conveys to the transverse sealing mechanism 240 the tubular film Ft formed by the former 212. The conveyance mechanism 220 has pull-down belts 226 having a suction function, and the conveyance mechanism 220 conveys the tubular film Ft downward as a result of drive rollers 222 around which the pull-down belts 226 are entrained being driven by a drive mechanism such as a motor (not shown in the drawings) in a state in which the pull-down belts 226 are sucking hold the film F.

The longitudinal sealing mechanism 230 seals the overlapping portion of the tubular film Ft at which the left and right end portions of the tubular film Ft overlap each other. The longitudinal sealing mechanism 230 is disposed in front of a path on which is conveyed the overlapping portion of the tubular film Ft, which is conveyed in a state in which the tubular film Ft is wrapped around the tube 214. The longitudinal sealing mechanism 230 has a built-in heater (not shown in the drawings) inside. When the longitudinal sealing mechanism 230 with its heater turned on is driven by a drive unit (not shown in the drawings) so that the longitudinal sealing mechanism 230 is pressed against the tube 214 via the tubular film Ft, the overlapping portion of the tubular film Ft is sealed in the up and down direction (the longitudinal direction).

As shown in FIG. 3, the transverse sealing mechanism 240 is disposed below the longitudinal sealing mechanism 230. The transverse scaling mechanism 240 transversely seals the top and bottom of a segment of the tubular film Ft corresponding to one bag B (used to make one bag B) to make a bag B containing the product C. Specifically, the transverse scaling mechanism 240 transversely seals, in a direction orthogonal to a conveyance direction A of the tubular film Ft, the longitudinally scaled tubular film Ft conveyed downward by the conveyance mechanism 220 to thereby form transverse seal portions of the bag B.

As shown in FIG. 3, the transverse sealing mechanism 240 mainly includes a pair of rotating bodies 242 disposed in front of and in back of the tubular film Ft. Each rotating body 242 includes an arm 243 that is configured to be rotatable about an axis of rotation X and sealing jaws 244*a*, 244*b* that are attached to the arm 243 and have built-in heaters. The scaling jaws 244*a* of both rotating bodies 242 function as a pair to transversely seal the tubular film Ft. The sealing jaws 244*b* of both rotating bodies 242 also function as a pair to transversely seal the tubular film Ft. The pair of scaling jaws 244*a* and the pair of scaling jaws 244*b* alternatingly transversely seal the tubular film Ft conveyed thereto. One of the pair of scaling jaws 244*a* and one of the pair of sealing jaws 244*b* are each provided with a cutter (not illustrated), and the transverse sealing mechanism 240 cuts the transversely sealed portion in a direction orthogonal to the conveyance direction A of the tubular film Ft to thereby cut the bag B away from the trailing tubular film Ft at the timing when the pair of scaling jaws 244*a* perform heat sealing or at the timing when the pair of sealing jaws 244*b* perform heat sealing.

(2-3) Metal Inspection Device

The metal inspection device 400 is disposed above the upper end of the tube 214 of the former mechanism 210. In other words, the metal inspection device 400 is disposed above the former mechanism 210. In particular, here the metal inspection device 400 is disposed directly above the former mechanism 210. At least part of the metal inspection device 400 is disposed forward of a center O of the tube 214. A definition for the center O of the tube 214 will be given later. The metal inspection device 400 inspects for metal contaminants in the product C dropped and supplied from the combination weigher to the opening in the upper end of the tube 214. The metal inspection device 400 is supported by the frame 500.

The metal inspection device 400 itself is a known device, so detailed description thereof will be omitted.

(2-4) Frame

Figure 4A:
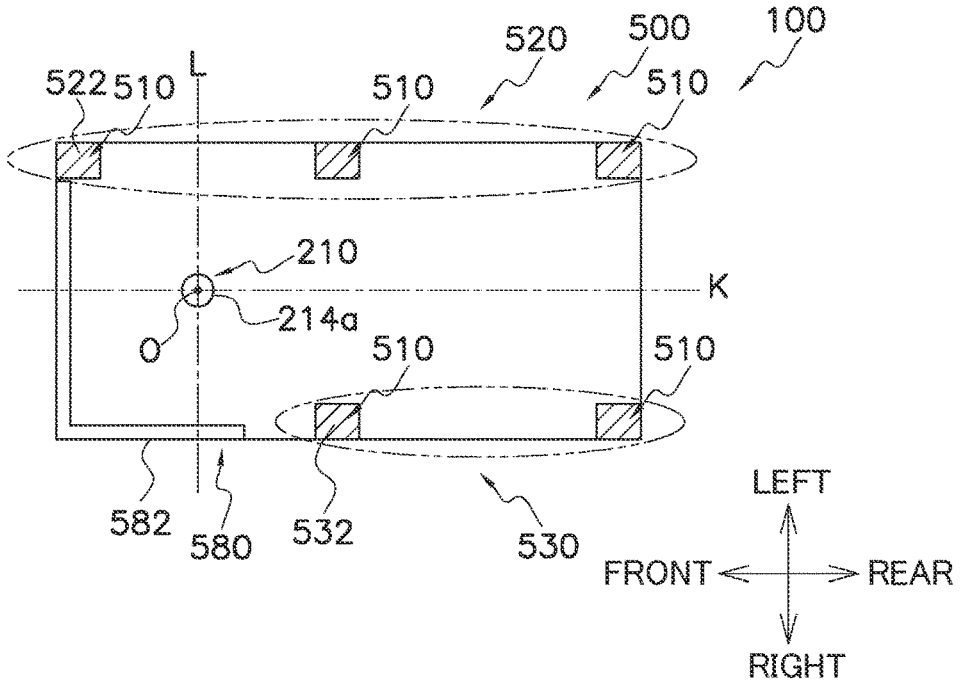
FIG. 4A is a schematic plan view illustrating the arrangement of support posts of a frame of the bagmaking and packaging apparatus of FIG. 1.
Figure 4B:
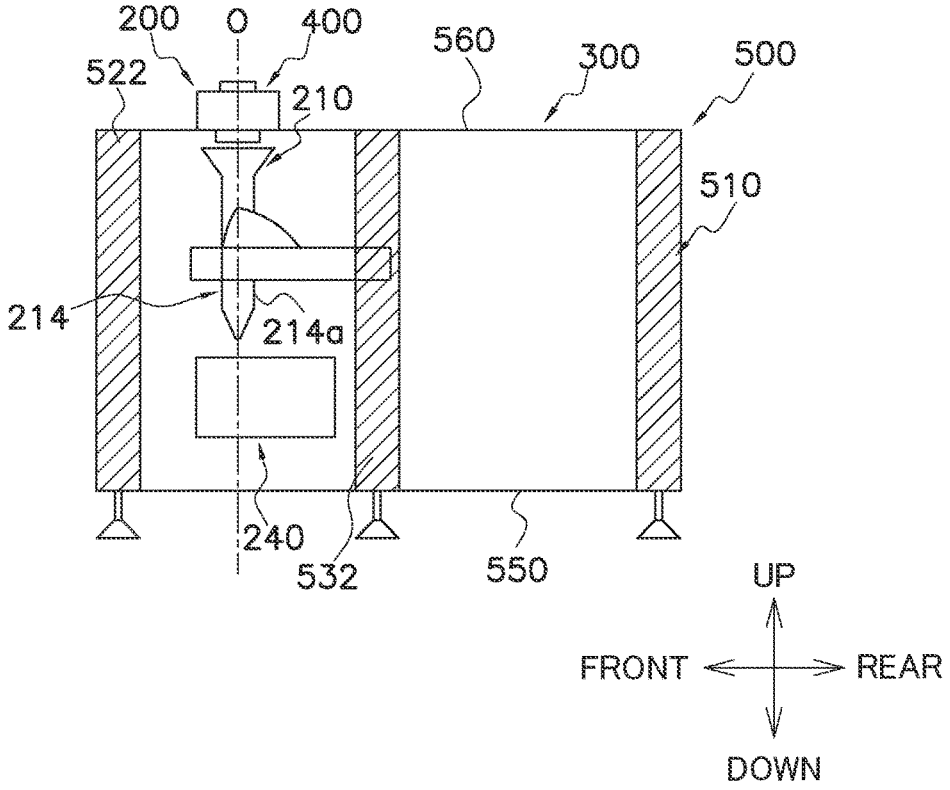
FIG. 4B is a schematic right side view illustrating the arrangement of the support posts of the frame of the bagmaking and packaging apparatus of FIG. 4A.

The frame 500 will now be described with reference to FIG. 4A and FIG. 4B. FIG. 4A is a schematic plan view illustrating the arrangement of support posts 510 of the frame 500 of the bagmaking and packaging apparatus 100. FIG. 4B is a schematic right side view illustrating the arrangement of the support posts 510 of the frame 500 of the bagmaking and packaging apparatus 100. It will be noted that in FIG. 4A and FIG. 4B hatching is added to the support posts 510 from the standpoint of facilitating understanding of the drawings.

The frame 500 supports various devices and parts of the film supply unit 300, various devices and parts of the bagmaking and packaging unit 200, and the metal inspection device 400 of the bagmaking and packaging apparatus 100.

The frame 500 includes, for example, multiple upright support posts 510 and beams that bridge the support posts 510. In other words, the frame 500 is configured by, for example, the support posts 510 and the beams. Here, particularly the support posts 510, which are the characteristic configuration of the bagmaking and packaging apparatus 100, will be mainly described.

The frame 500 having the multiple support posts 510 surrounds at least part of each of the film supply unit 300, the former mechanism 210, and the transverse sealing mechanism 240.

Here, the recitation that the frame 500 surrounds at least part of the film supply unit 300 means that, when viewed from above, at least part of the film supply unit 300 is disposed in an area (in the rectangle in FIG. 4A) defined by a virtual line extending in the left and right direction and passing through the support post 510 disposed foremost, a virtual line extending in the left and right direction and passing through the support posts 510 disposed rearmost, a virtual line extending in the front and rear direction and passing through the support posts 510 disposed rightmost, and a virtual line extending in the front and rear direction and passing through the support posts 510 disposed leftmost. The meanings of the recitation that the frame 500 surrounds at least part of the former mechanism 210 and the recitation that the frame 500 surrounds at least part of the transverse sealing mechanism 240 are similarly defined.

The support posts 510 include a first support post group 220 including a plurality of the support posts 510 disposed on one lateral side of the bagmaking and packaging apparatus 100 in the left and right direction (relative to a virtual line K extending in the front and rear direction through the left and right direction center of the bagmaking and packaging apparatus 100) and a second support post group 530 including a plurality of the support posts 510 disposed on the other lateral side in the left and right direction (see FIG. 4A). In the present embodiment, the support posts 510 included in the first support post group 520 are disposed on the left side in the bagmaking and packaging apparatus 100. The support posts 510 included in the second support post group 530 are disposed on the right side in the bagmaking and packaging apparatus 100. It will be noted that this arrangement of the first support post group 520 and the second support post group 530 is merely an example, and the first support post group 520 having later-described characteristics may be disposed on the right side in the bagmaking and packaging apparatus 100 and the second support post group 520 having later-described characteristics may be disposed on the left side in the bagmaking and packaging apparatus 100.

In the bagmaking and packaging apparatus 100, the support posts 510 are arranged asymmetrically relative to the virtual line K extending through the left and right direction center of the bagmaking and packaging apparatus 100.

Specifically, a first support post 522 disposed foremost among the support posts 510 of the first support post group 520 is disposed forward of the center O of the tube 214

(forward of a virtual line L passing through the center O) when viewed from above. More preferably, the first support post 522 is disposed forward of the tube 214 (in particular, here, the portion 214*a* of the tube 214 around which the tubular film Ft formed in the tubular shape by the former 212 is wrapped). In contrast, a second support post 532 disposed foremost among the support posts 510 of the second support post group 530 is disposed rearward of the center O of the tube 214 (rearward of the virtual line L passing through the center O) when viewed from above. More preferably, the second support post 532 is disposed rearward of the tube 214 (in particular, here, portion 214*a* of the tube 214).

It will be noted that, here, the center O of the tube 214 means the position of the center of gravity of a cross-section obtained by horizontally cutting the portion 214*a* of the tube 214. For example, if the cross-sectional shape of the portion 214*a* of the tube 214 is circular, the center O of the tube 214 is the center of the cross-section obtained by horizontally cutting the portion 214*a* of the tube 214. It will be noted that the cross-sectional shape of the portion 214*a* of the tube 214 may also be a shape other than circular, and the outer shape of the portion 214*a* of the tube 214 may also be oval, for example.

The first support post 522 extends from a position lower than the transverse sealing mechanism 240 to a position higher than the transverse sealing mechanism 240. The second support post 532 also extends from a position lower than the transverse sealing mechanism 240 to a position higher than the transverse sealing mechanism 240. For example, specifically, the first support post 522 and the second support post 532 extend from a base 550 in the bottom portion of the bagmaking and packaging apparatus 100 to a position higher than the upper end of the tube 214 of the former mechanism 210.

The first support post 522 and the second support post 532, for example, directly or indirectly support the former mechanism 210. Particularly, the first support post 522 supports the metal inspection device 400 that is a heavy object disposed higher than the former mechanism 210. The first support post 522 supports a cover 580 of the bagmaking and packaging apparatus 100.

Here, the cover 580 is a member that covers the front side and the right side of the former mechanism 210. The cover 580 is attached to the first support post 522, and the first support post 522 supports the cover 580. The cover 580 is a door 582 that can be opened and closed. During maintenance, for example, a worker can access the former mechanism 210, the conveyance mechanism 220, and the longitudinal sealing mechanism 230 by swinging the door 582 on hinges provided on the first support post 522 (see FIG. 2).

Below, beneficial results obtained by arranging the support posts 510 as illustrated in FIG. 4A and FIG. 4B will be described with reference also to FIG. 5A to FIG. 7B.

It will be noted that here the frame 500 of the bagmaking and packaging apparatus 100 of the present embodiment has five support posts 510. A frame 500A of a bagmaking and packaging apparatus 1000A shown in FIG. 5A and FIG. 5B as a first example of the prior art and a frame 500B of a bagmaking and packaging apparatus 1000B shown in FIG. 6A and FIG. 6B as a second example of the prior art each has six support posts 510A, 510B. A frame 500C of a bagmaking and packaging apparatus 1000C shown in FIG. 7A and FIG. 7B as a third example of the prior art has four support posts 510C.

Here, the support posts 510, 510A, 510B, 510C are posts provided upright from the bases (bottom portions) 550 to tops (uppermost portions) 560 of the frames 500, 500A, 500B, 500C. The bagmaking and packaging apparatus 1000A to 1000C have the same configurations as those of the bagmaking and packaging apparatus 100 except for the frames 500A to 500C.

However, a feature of the frame 500 of the bagmaking and packaging apparatus 100 of the present embodiment is the arrangement of the first support post 522 of the first support post group 520 and the second support post 532 of the second support post group 530, and the number of the supports 510 is arbitrary as long as the support posts 510 can support the various devices and parts of the bagmaking and packaging apparatus 100. Furthermore, the support posts 510 of the bagmaking and packaging apparatus 100 may include support posts 510 provided upright from positions higher than the base 550 of the frame 500 and/or support posts 510 provided upright as far as positions lower than the top 560 of the frame 500.

In the example of FIG. 4A, the plural support posts 510 include three support posts 510 of the first support post group 520 disposed on the left side and two support posts 510 of the second support post group 530 disposed on the right side. In the example of FIG. 4A, as mentioned above, the support posts 510 are arranged asymmetrically relative to the virtual line K extending through the left and right direction center of the bagmaking and packaging apparatus 100.

One advantage of the structure of the frame 500 of the bagmaking and packaging apparatus 100 of the present embodiment is that it is easy to ensure, on the side where the second support post group 530 is disposed (here, the right side) in the left and right direction, work space for the former mechanism 210 and the like. Specifically, as shown in FIG. 2, when a worker opens the door 582 of the cover 580, it is easy for the worker to enter from the right side or the right front side of the bagmaking and packaging apparatus 100, grip the grip unit 218 of the former mechanism 210, and detach the former mechanism 210 from the bagmaking and packaging apparatus 100, because on the right side of the bagmaking and packaging apparatus 100 there is no support post 510 at least in front of the center O of the tube 214. Furthermore, because on the right side of the bagmaking and packaging apparatus 100 there is no support post 510 at least forward of the center O of the tube 214, detachment of the former mechanism 210 is less likely to be obstructed by a support post 510.

Another advantage of this structure is the stability of the structure of the frame 500. Specifically, because the first support post 522 is disposed forward of the center O of the tube 214 on the side in the left and right direction where the first support post group 520 is disposed (here, the left side), a heavy object like the metal inspection device 400 (particularly in the present embodiment, part of the heavy object is disposed forward of the center O of the tube 214 as in FIG. 4B) disposed above the former mechanism 210 and the cover 580 disposed around the former mechanism 210 can be solidly supported.

The frame 500 of the bagmaking and packaging apparatus 100 of the present embodiment will now be compared with the frames 500A, 500B, 500C of the prior-art bagmaking and packaging apparatus 1000A, 1000B, 1000C.

Figure 5A:
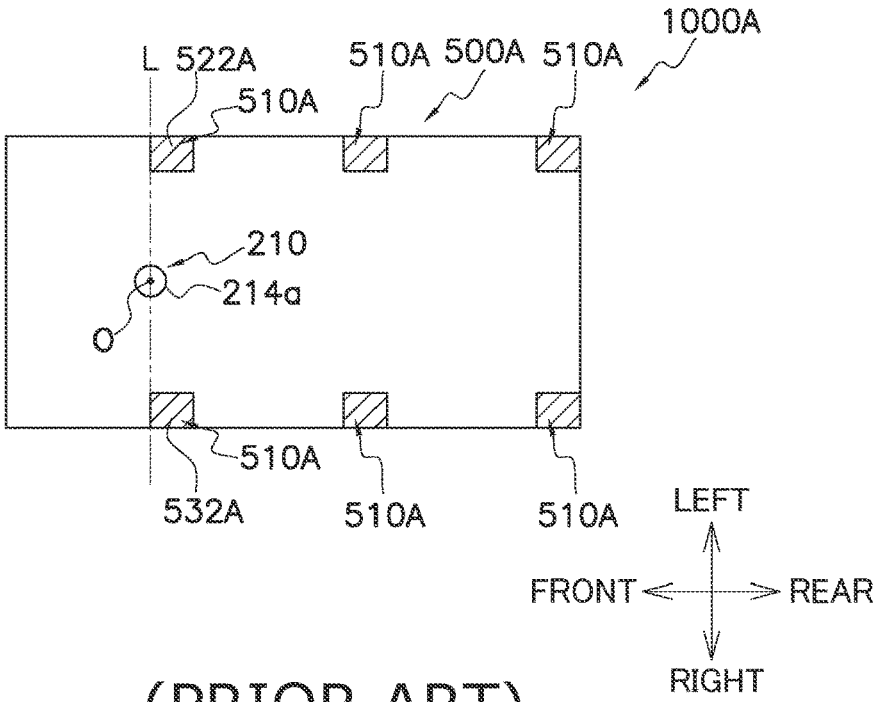
(PRIOR ART) F I G. 5 A
FIG. 5A is a schematic plan view illustrating the arrangement of support posts of a first example of a bagmaking and packaging apparatus according to the prior art.
Figure 5B:
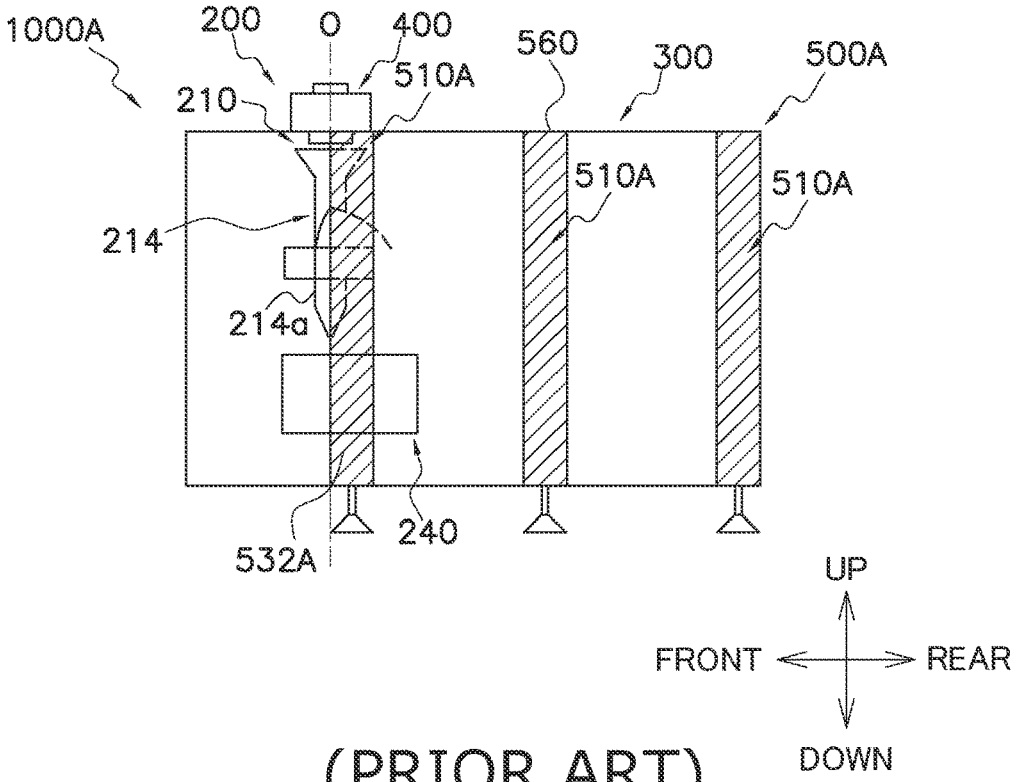
(PRIOR ART) F I G. 5 B
FIG. 5B is a schematic right side view illustrating the arrangement of the support posts of the prior-art bagmaking and packaging apparatus of FIG. 5A.
Figure 6A:
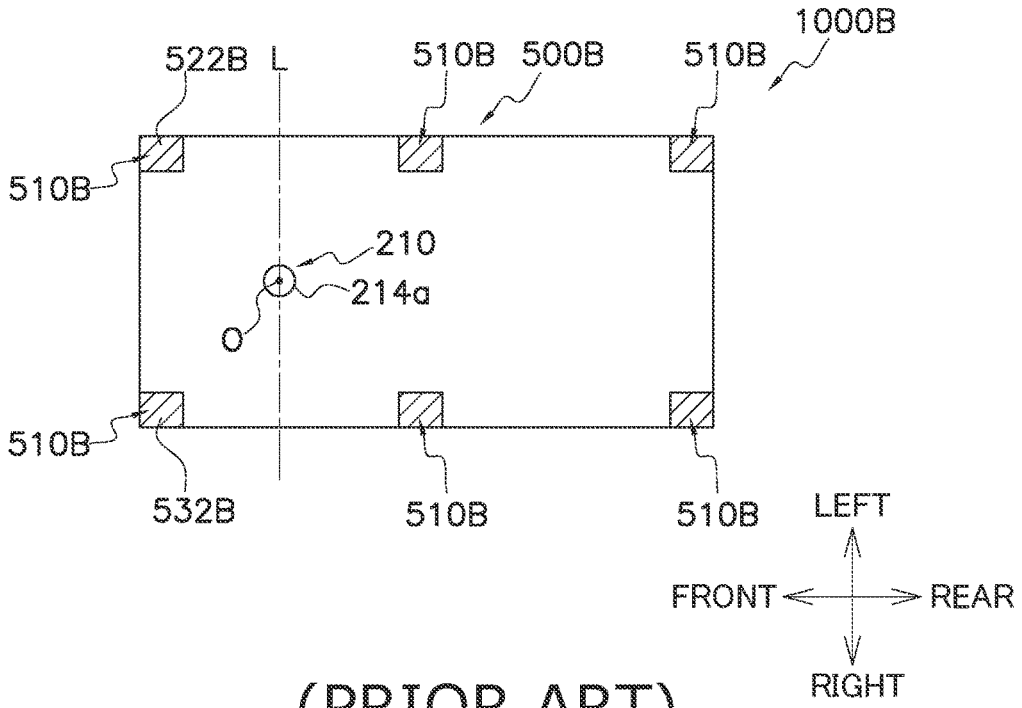
(PRIOR ART) FIG. 6A
FIG. 6A is a schematic plan view illustrating the arrangement of support posts of a second example of a bagmaking and packaging apparatus according to the prior art.
Figure 6B:
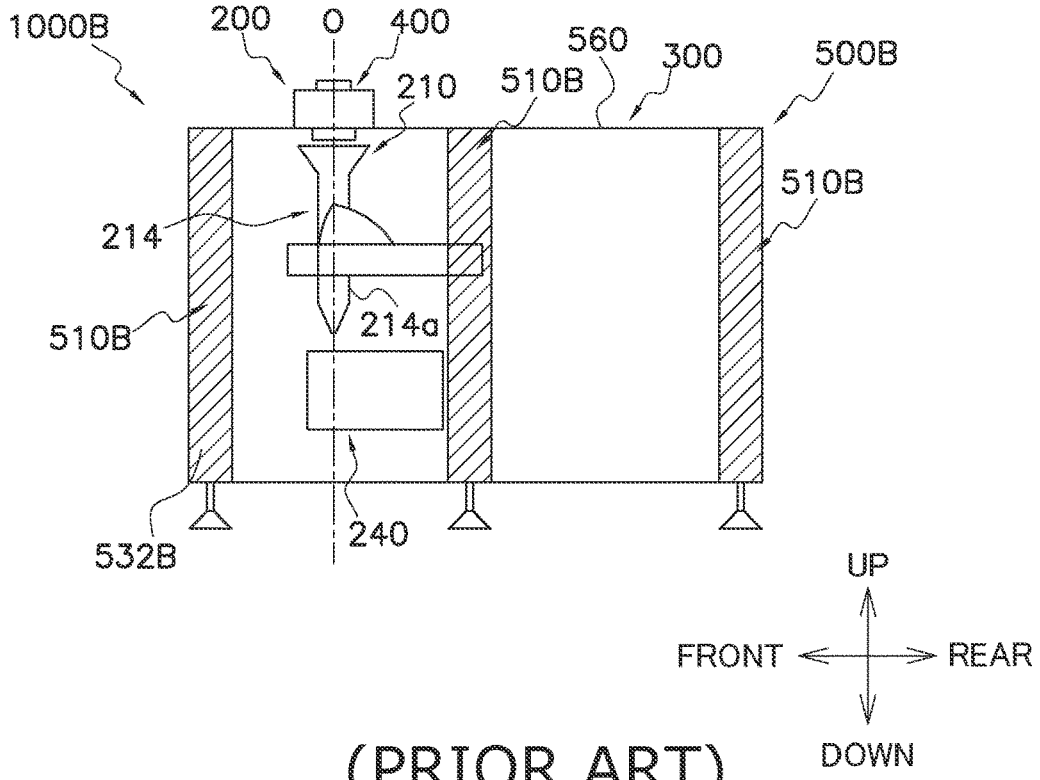
(PRIOR ART) FIG. 6B
FIG. 6B is a schematic right side view illustrating the arrangement of the support posts of the prior-art bagmaking and packaging apparatus of FIG. 6A.
Figure 7A:
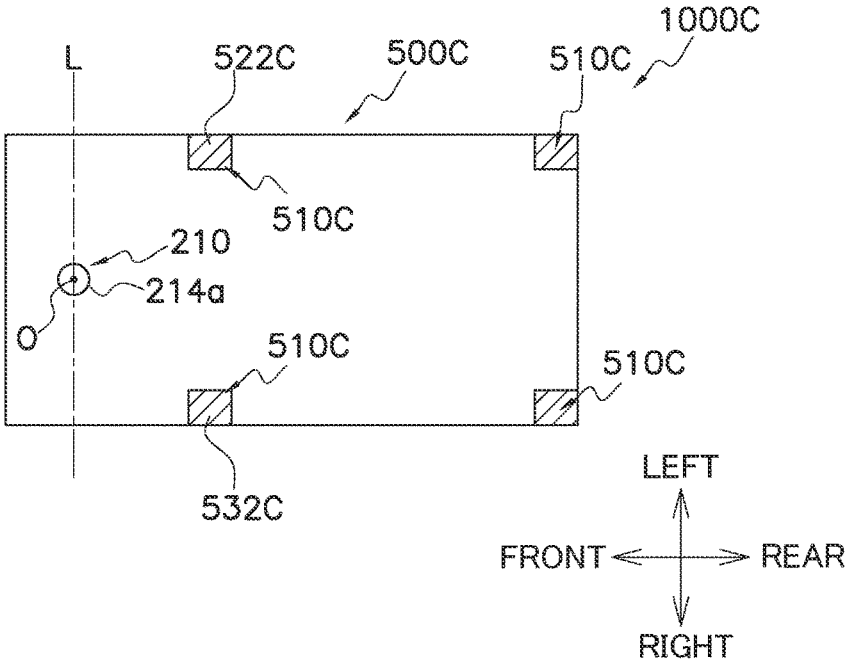
(PRIOR ART) F I G. 7 A
FIG. 7A is a schematic plan view illustrating the arrangement of support posts of a third example of a bagmaking and packaging apparatus according to the prior art.
Figure 7B:
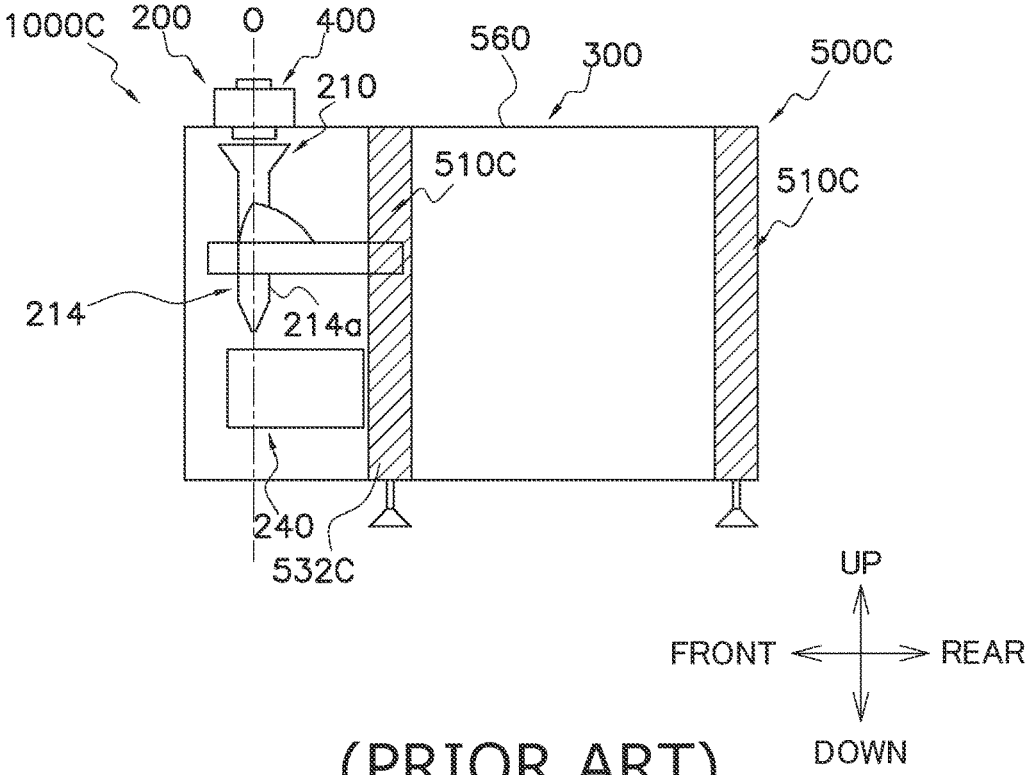
(PRIOR ART) F I G. 7 B
FIG. 7B is a schematic right side view illustrating the arrangement of the support posts of the prior-art bagmaking and packaging apparatus of FIG. 7A.

In the frame 500A of the bagmaking and packaging apparatus 1000A, as shown in FIG. 5A and FIG. 5B, left and right foremost support posts 522A, 532A are both disposed in positions in which their front ends coincide with the center O of the tube 214 (on the virtual line L extending in the left and right direction and passing through the center O). With this configuration, work space is ensured to a certain extent. However, because both the left and right foremost support posts 522A, 532A are not disposed forward of the center O of the tube 214, it is difficult to stably support a heavy object like the metal inspection device 400 above the former mechanism 210. Furthermore, because both the left and right foremost support posts 522A, 532A are not disposed forward of the center O of the tube 214, it becomes difficult to solidly support the cover 580 disposed around the former mechanism 210. Furthermore, because both the left and right foremost support posts 522A, 532A are disposed in positions in which their front ends coincide with the center O of the tube 214, maintainability is not sufficiently high compared with a case where the second support post 532 is disposed rearward of the center O of the tube 214 as in the bagmaking and packaging apparatus 100 of the present embodiment.

Next, in the frame 500B of the bagmaking and packaging apparatus 1000B, the foremost support posts 522B, 532B on the left and right are both disposed forward of the tube 214. With this arrangement of the support posts 522B, 532B, the metal inspection device 400 that is a heavy object above the former mechanism 210 and the cover 580 disposed around the former mechanism 210 can be stably supported. However, owing to the presence of the support posts 522B, 532B, maintainability is poor as described above. It will be noted that if the foremost support posts 522B, 532B were disposed further away from the support posts 510B, 510B in the second row from the front, maintainability might be able to be ensured, but this causes another problem, which is that the installation space of the bagmaking and packaging apparatus 1000B increases.

Next, in the frame 500C of the bagmaking and packaging apparatus 1000C, foremost support posts 522C, 532C on the left and right are both disposed rearward of the tube 214. With this configuration, work space is easily ensured and the maintainability of the bagmaking and packaging apparatus 1000C is high. However, because both the left and right foremost support posts 522C, 532C are not disposed forward of the tube 214, the former mechanism 210 and the metal inspection device 400 become a cantilever structure, and it is difficult for the former mechanism 210 and the metal inspection device 400 to be stably supported. Moreover, it also becomes difficult for the cover 580 disposed around the former mechanism 210 to be solidly supported.

As is apparent from the above comparisons, with the bagmaking and packaging apparatus 100 of the present embodiment, a balance between stable support of various devices and parts and high maintainability, which could not be obtained with the configurations of the conventional bagmaking and packaging apparatus, can be achieved without increasing the apparatus size.

(3) Characteristics (3-1)

The bagmaking and packaging apparatus 100 performs bagmaking and packaging. In the bagmaking and packaging, the former mechanism 210, which includes the former 212 and the tube 214 and is disposed forward of the film supply unit 300 disposed in the rear portion of the bagmaking and packaging apparatus 100, forms in a tubular shape the sheet-like film F supplied from the film supply unit 300, and the transverse sealing mechanism 240 transversely seals the tubular film (the tubular film Ft) into which the product C supplied from above is fed. The bagmaking and packaging apparatus 100 includes the multiple upright support posts 510. The support posts 510 form the frame 500 that surrounds at least part of each of the film supply unit 300, the former mechanism 210, and the transverse sealing mechanism 240. The multiple support posts 510 include the first support post group 520 and the second support post group 530. Each of the first support post group 520 and the second support post group 530 includes a plurality of the support posts 510. The support posts 510 of the first support post group 520 are disposed on one lateral side of the bagmaking and packaging apparatus 100 in the left and right direction, and the support posts 510 of the second support post group 530 are disposed on the other lateral side of the bagmaking and packaging apparatus 100 in the left and right direction. The first support post 522 disposed foremost among the support posts 510 of the first support post group 520 extends from a lower position to a position higher than the transverse sealing mechanism 240 and, when viewed from above, is disposed forward of the center O of the tube 214. The second support post 532 disposed foremost among the support posts 510 of the second support post group 530 extends from a lower position to a position higher than the transverse scaling mechanism 240 and, when viewed from above, is disposed rearward of the center O of the tube 214.

In the bagmaking and packaging apparatus 100, because the second support post 532 is disposed in the above-described position, maintenance space can be ensured on the side of the bagmaking and packaging apparatus 100 in the left and right direction where the second support post group 530 is disposed while inhibiting an increase in the size of the bagmaking and packaging apparatus 100.

Furthermore, in the bagmaking and packaging apparatus 100, on the side of the bagmaking and packaging apparatus 100 in the left and right direction where the first support post group 520 is disposed, the first support post 522 is disposed in the above-described position. Thus, various devices and parts of the bagmaking and packaging apparatus 100 can be solidly supported.

(3-2)

In the bagmaking and packaging apparatus 100, the first support post 522 is disposed forward of the tube 214.

In the bagmaking and packaging apparatus 100, even when a heavy object is disposed forward of the second support post 532 in the upper portion of the bagmaking and packaging apparatus 100 or when the bagmaking and packaging apparatus 100 is provided with a part that causes the bagmaking and packaging apparatus 100 to vibrate, the heavy object can be solidly supported and vibration of the bagmaking and packaging apparatus 100 can be inhibited.

(3-3)

In the bagmaking and packaging apparatus 100, the second support post 532 is disposed rearward of the tube 214.

In the bagmaking and packaging apparatus 100, it is easy to ensure sufficient work space around the former mechanism 210. For example, when replacing the former mechanism 210, movement of the former mechanism 210 is less likely to be obstructed by the second support post 532.

(3-4)

In the bagmaking and packaging apparatus 100, the first support post 522 supports a member disposed above the former mechanism 210. Specifically, in the present embodiment, the first support post 522 supports the metal inspection device 400 disposed directly above the former mechanism 210.

Because the bagmaking and packaging apparatus 100 has the first support post 522 disposed in the above-described position, even if a heavy object such as the metal inspection device 400 is disposed directly above the former mechanism 210, the heavy object can be solidly supported by the frame 500 without upsetting the balance in the support.

(3-5)

The bagmaking and packaging apparatus 100 includes the cover 580 that covers at least the front side of the former mechanism 210. The cover 580 of this bagmaking and packaging apparatus 100 covers the front side, the left side, and the right side of the former mechanism 210. The first support post 522 supports the cover 580.

In this bagmaking and packaging apparatus 100, the cover 580 that covers the former mechanism 210 is installed from the standpoint of safety and hygiene. In the bagmaking and packaging apparatus 100, the cover 580 can be solidly supported by the first support post 522 disposed in the above-described position.

(4) Example Modifications

Examples of modifications of the above-described embodiment will be described below. It will be noted that some or all of the content of each example modification may be combined with the content of the above embodiment and/or the content of another example modification to the extent that they are not mutually contradictory.

(4-1) Example Modification A

Figure 8:
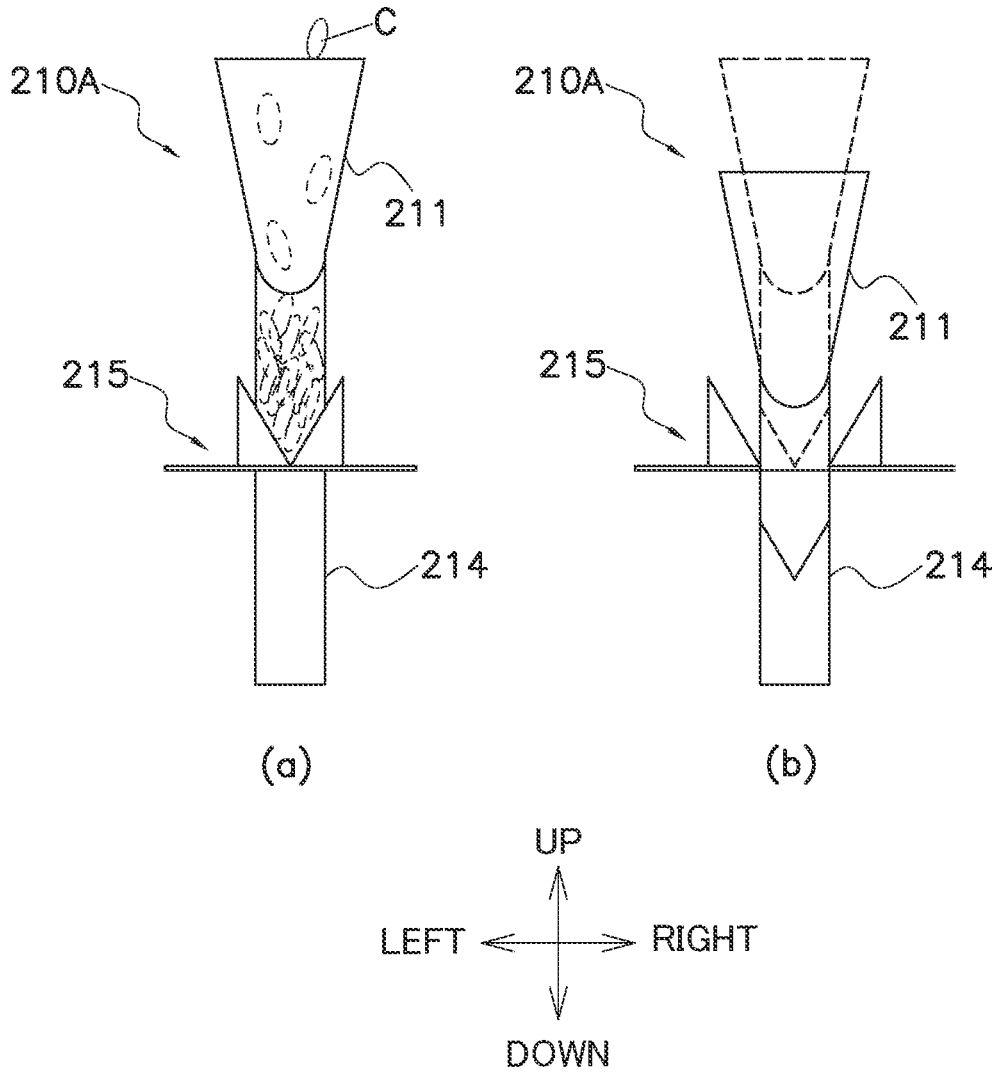
FIG. 8 is a front view illustrating a former mechanism of the bagmaking and packaging apparatus pertaining to example modification A, with illustration of a former, a plate, and a grip unit being omitted.

The bagmaking and packaging apparatus 100 may have a former mechanism 210A as illustrated in FIG. 8 instead of the former mechanism 210. FIG. 8 is a front view illustrating the former mechanism 210A of the bagmaking and packaging apparatus 100 pertaining to example modification A, with illustration of the former 212, the plate 216, and the grip unit 218 being omitted.

The former mechanism 210A has, in addition to the configurations of the former mechanism 210 of the above embodiment, a shutter 215 that moves in the left and right direction and a chute 211 that moves in the up and down direction. The shutter 215 and the chute 211 are disposed above the former 212 and the tube 214.

The chute 211 is a funnel-shaped member that moves up and down between an upper position shown in FIG. 8(*a*) and a lower position shown in FIG. 8(*b*). The chute 211 is disposed directly under the combination weigher, and the opening in the upper portion thereof receives the supply of the product C falling from above.

The chute 211 is mainly disposed in the upper position at the timing when the product C is supplied from the combination weigher. The shutter 215 is disposed under the chute 211 disposed in the upper position, and particularly in the vicinity of the lower end of the chute 211. At the timing when the product C is supplied from the combination weigher, the shutter 215 is mainly in a state in which it is closed as in FIG. 8(*a*) and closes off the opening in the lower end of the chute 211. When the product C is supplied in this state, the product C is accumulated inside the chute 211.

Then, for example, near the end of the timing when the product C is supplied from the combination weigher, or at the timing when the supply of the product C from the combination weigher has ended, the shutter 215 opens and, at the same time, the chute 211 quickly descends inside the tube 214 from the upper position (see the dashed lines in FIG. 8(*b*)) to the lower position (see the solid lines in FIG. 8(*b*)), and when the chute 211 reaches the lower position, it immediately changes direction and quickly ascends to the upper position. In this configuration, the product C can be supplied in an aggregated state to the tubular film Ft in a short amount of time.

However, when the bagmaking and packaging apparatus 100 has such movable members (the chute 211 and the shutter 215), vibration may occur as a result of the movable members moving.

However, because the bagmaking and packaging apparatus 100 has the first support post 522 disposed in the above-described position, the stability of the frame 500 is high, and even if movable members that cause vibration are present, vibration of the bagmaking and packaging apparatus 100 can be reliably inhibited.

REFERENCE SIGNS LIST

| | |
|---|---|
| 100: | Bagmaking and Packaging Apparatus |
| 210: | Former Mechanism |
| 210A: | Former Mechanism |
| 211: | Chute (Movable Member) |
| 212: | Former |
| 214: | Tube |
| 215: | Shutter |
| 240: | Transverse Sealing Mechanism |
| 300: | Film Supply Unit |
| 400: | Metal Inspection Device |
| 500: | Frame |
| 510: | Support Posts |
| 520: | First Support Post Group |
| 522: | First Support Post |
| 530: | Second Support Post Group |
| 532: | Second Support Post |
| 580: | Cover |
| C: | Product |
| F: | Film |
| Ft: | Tubular Film |
| O: | Center (Center of Tube) |

The invention claimed is:

1. A bagmaking and packaging apparatus comprising a film supply unit disposed in a rear portion of the apparatus and configured to supply sheet-form film;

a former mechanism including a former and a tube and being disposed forward of the film supply unit, the former mechanism configured to form in a tubular shape the sheet-form film supplied from the film supply unit, a transverse sealing mechanism configured to transversely seal the tubular film in which a product being supplied from above; and a plurality of upright support posts that form a frame that surrounds at least part of each of the film supply unit, the former mechanism, and the transverse sealing mechanism, wherein the support posts include a first support post group including a plurality of the support posts disposed on one lateral side of the bagmaking and packaging apparatus in a left and right direction; and a second support post group including a plurality of the support posts disposed on the other lateral side in the left and right direction, a first support post disposed foremost among the support posts of the first support post group extends from a low position to a position higher than the transverse sealing mechanism and, when viewed from above, is disposed forward of a center of the tube, and a second support post disposed foremost among the support posts of the second support post group extends from a low position to a position higher than the transverse sealing mechanism and, when viewed from above, is disposed rearward of the center of the tube.

2. The bagmaking and packaging apparatus of claim 1, wherein the first support post is disposed forward of the tube.

3. The bagmaking and packaging apparatus of claim 1, wherein the second support post is disposed rearward of the tube.

4. The bagmaking and packaging apparatus of claim 1, wherein the first support post supports a member disposed above the former mechanism.

5. The bagmaking and packaging apparatus claim 1, further comprising a cover that is configured to cover at least a front side of the former mechanism, wherein the first support post supports the cover.

6. The bagmaking and packaging apparatus of claim 1, wherein the first support post supports a movable member.

* * * * *